US006382770B1

(12) United States Patent
Kitamura

(10) Patent No.: US 6,382,770 B1
(45) Date of Patent: May 7, 2002

(54) METHOD FOR PRODUCING APERTURE ELECTRODE MEMBER

(75) Inventor: Tetsuya Kitamura, Gifu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/164,381

(22) Filed: Oct. 1, 1998

(30) Foreign Application Priority Data

Oct. 3, 1997 (JP) ..... 9-271242

(51) Int. Cl.[7] ..... B41J 2/06
(52) U.S. Cl. ..... 347/55
(58) Field of Search ..... 347/55, 151, 120, 347/141, 154, 103, 123, 111, 159, 127, 128, 131, 125, 158; 216/48, 4; 29/890.1; 399/271, 290, 292, 293, 294

(56) References Cited

U.S. PATENT DOCUMENTS 3,689,935 A 9/1972 Pressman et al.
5,497,175 A 3/1996 Maeda
5,552,814 A 9/1996 Maeda et al.
5,889,540 A * 3/1999 Leonard et al. ..... 347/55
6,011,944 A * 1/2000 Nilsson ..... 347/55

FOREIGN PATENT DOCUMENTS

JP A-6-79907 3/1994
JP A-7-117262 5/1995

* cited by examiner

*Primary Examiner*—Raquel Yvette Gordon
(74) *Attorney, Agent, or Firm*—Oliff & Berridge, PLC

(57) ABSTRACT

The coat liquid 34 is applied all over the under surface 2*b* of the insulation sheet 2. At this time, the coat liquid 31 is also applied into the apertures 7. Excessive coat liquid 35 is absorbed by the absorption sheet 32 places over the upper surface 2*a* of the insulation sheet 2. As a result, the preferable amount of the coat liquid 34 is coated over the under surface 2*b* and the aperture side walls 7*b* defining the apertures 7. When the coat liquid 34 is dried and hardened the slide facilitating layer 20 and the charge prevention layer 70 are formed on the under surface 2*b* and the aperture side walls 7*b*.

19 Claims, 6 Drawing Sheets

METHOD FOR PRODUCING APERTURE ELECTRODE MEMBER

BACKGROUND OF THE INVENTION

1. Field of the Invention

The present invention relates to a method of producing an aperture electrode member for use in an image forming device such as a facsimile machine, a plotter, a printer, or a copy machine.

2. Description of Related Art

U.S. Pat. No. 3,689,935 discloses an image forming device including an aperture electrode member, a biasing member, a toner supply member, and a medium supply unit. The aperture electrode member includes a substrate a reference electrode formed on a first surface of the substrate, and a plurality of electrodes formed on a second surface of the substrate which is opposite from the first surface. The substrate is formed from an electrically insulated material. The plurality of control electrodes are electrically insulated from each other. The aperture electrode member is formed with a plurality of apertures arranged in a row. Each aperture corresponds to one of the control electrodes and completely passes through the corresponding control electrode, the substrate, and the reference electrode.

The biasing member is provided for selectively applying voltages to the reference electrode and the control electrodes so that an electrical bias is generated between the reference electrode and the control electrodes. The toner supply member is positioned confronting the second surface of the aperture electrode member for supplying electrically charged toner particles to the aperture electrode member. The toner particles supplied from the toner supply member are selectively pulled through the apertures as controlled by the bias developed between the control electrodes and the reference electrode. Then the toner particles that passed through the apertures impinge against a recording medium supplied by the medium supplying unit. In this way a desired toner image is formed on the recording medium.

The Japanese Patent-Application Publication (Kokai) No. HEI-6-79907 also discloses an image forming device including an aperture electrode member, a toner supply roller, and a frame. The aperture electrode member is formed with apertures and includes a plurality of control electrodes provided on a surface of the aperture electrode member. The frame supports the aperture electrode member at its surface. The toner supply roller is positioned in contact with the surface of the aperture electrode member for supplying toner particles to the apertures. In order to supply a uniform amount of toner particles to the apertures, the toner supply roller needs to uniformly contact the aperture electrode member especially at portions near the apertures.

The above-described aperture electrode members are produced by processes described below.

First, a substrate is formed from an electrically insulating material, such as a polyimide. Then control electrodes are formed by forming a copper film pattern on a first surface of the substrate.

Next, an excimer laser is irradiated onto the substrate to induce ablation reaction. As a result, apertures penetrating both the substrate and the control electrodes are formed. Thus formed apertures can have an extremely clean shape. However, the ablation reaction generates carbon particles, and these carbon particles cling to the substrate, specifically, on the surface surrounding the apertures and on aperture side walls defining the apertures. The carbon particles are removed from the substrate by ultrasonic cleaning methods or plasma etching methods.

If static electricity is generated in the aperture, toner particles will not pass through the apertures but will instead cling onto the aperture side walls, thereby clogging the aperture. Therefore, a charge prevention coat layer is formed for preventing static electricity from being generated in the aperture. The charge prevention coat layer is formed on the aperture side walls by introducing a coat liquid into the apertures. The coat liquid is polyimide ink with carbon particles dispersed therein.

However, in the above-described processes, the coat liquid introduced into the apertures may completely close up the apertures. Also, the coat liquid may overflow out of the apertures and cling onto the surfaces of the substrate. When the coat liquid dries and hardens, the coat liquid makes rough and uneven bumps on the surfaces of the substrate around and in the apertures.

When an aperture electrode member with such uneven surfaces is used in the image forming device of Japanese Patent-Application Publication (Kokai) No. HEI-6-79907 described above, the toner supply roller will not uniformly contact with the aperture electrode member. This prevents the toner supply roller from uniformly supplying toner particles to the apertures.

Further, because only the aperture side walls are covered with the charge prevention coat layer, toner particles contact a different kind of material, that is, the surface of the substrate and the charge prevention coat layer, after being supplied to the aperture electrode member until impinging on the recording medium. This prevents precise control of flow of toner particles through the apertures.

SUMMARY OF THE INVENTION

It is an objective of the present invention to overcome the above-described problems and also to provide a method of producing an aperture electrode member without closing up apertures with coat liquid.

It is another objective of the present invention to provide an aperture electrode member capable of uniformly contacting at area around apertures with a toner bearing roller and a method of producing the aperture electrode member.

It is still another objective of present invention to provide an aperture electrode member capable of precise control of flow of toner particles through apertures.

In order to provide the above and other objectives, there is provided an aperture electrode assembly for use in an image forming device including a recording particle supply unit for supplying electrically charged recording particles for the aperture electrode assembly. The aperture electrode assembly including a substrate and a plurality of electrodes. The substrate is formed with a plurality of apertures through which electrically charged recording particles pass through. Each of the plurality of apertures is defined by an aperture side wall. The substrate has a first surface and a second surface. The first surface of the substrate is covered with a first layer, and the aperture side walls is covered with a second layer. The substrate is designed to be positioned so that at least a portion of the first surface is in intimate contact with the recording particle supplying member. The first layer and the second layer are formed from a same material. The plurality of electrodes are provided on the second surface of the substrate for respective ones of the plurality of apertures.

There is also provided an image forming device including a recording particle supply unit, an aperture electrode assembly, a frame, and a control unit. The particle supply unit supplies electrically charged recording particles. The aperture electrode assembly includes a substrate and a plurality of control electrodes. The substrate has a first surface coated with a first layer and a second surface. The substrate is formed with a plurality of apertures each defined by an aperture side wall coated with a second layer. The plurality of control electrodes are provided on the second surface of the substrate for respective ones of the plurality of apertures. The first layer and the second layer are formed from a same material. The frame supports the aperture electrode assembly such that at least a portion of the first surface is in intimate contact with the recording particle supply unit. The control unit generates an electric field between the recording particle supply unit and selective control electrodes so that the electrically charged recording particles are selectively pulled through respective apertures toward the selective control electrodes due to an electrostatic attraction of the electric field.

Further, there is provided a method of producing an aperture electrode assembly. The method includes the steps of a) forming a plurality of electrode members on a first surface of a substrate, b) forming a plurality of apertures penetrating the substrate and respective ones of the plurality of electrode members, the plurality of electrode members formed with corresponding ones of the plurality of apertures defining a plurality of electrodes, the plurality of apertures being defined by aperture side walls, c) applying coat liquid onto a second surface of the substrate and into the plurality of apertures from a second surface side of the substrate; and d) drying the coat liquid so as to form a coat layer over the second surface and the aperture side walls.

BRIEF DESCRIPTION OF THE DRAWING

The particular features and advantages of the invention as well as other objects will become more apparent from the following description taken in connection with the accompanying drawings in which.

FIG. 4(*b*) is a cross-sectional view taken along a line A—A' of FIG. 4(*a*);

FIG. 5(*b*) is a cross-sectional view taken along a line B—B' of FIG. 5(*a*);

FIG. 6(*b*) is a cross-sectional view taken along a line C—C' of FIG. 6(*a*)

FIG. 7(*b*) is a plan view showing the aperture electrode member of FIG. 7(*a*) as viewed from the above;

FIG. 8(*b*) is a plan view showing the aperture electrode member of FIG. 8(*a*) as viewed from the above;

FIG. 9(*b*) is a plan view showing the aperture electrode member of FIG. 9(*a*) as viewed from the above.

DETAILED DESCRIPTION OF THE PREFERRED EMBODIMENT

A method for producing the aperture electrode member according to a preferred embodiment of the present invention will be described while referring to the accompanying drawings. In the following description, the expressions "above", "beneath", "upper", "under", "vertical", "right", and "left" are used throughout the description to define the various parts when the aperture electrode member to disposed in an orientation in which it is intended to be used.

First, an image forming device including an aperture electrode member of the present invention will be described while referring to FIG. 1.

Figure 1:
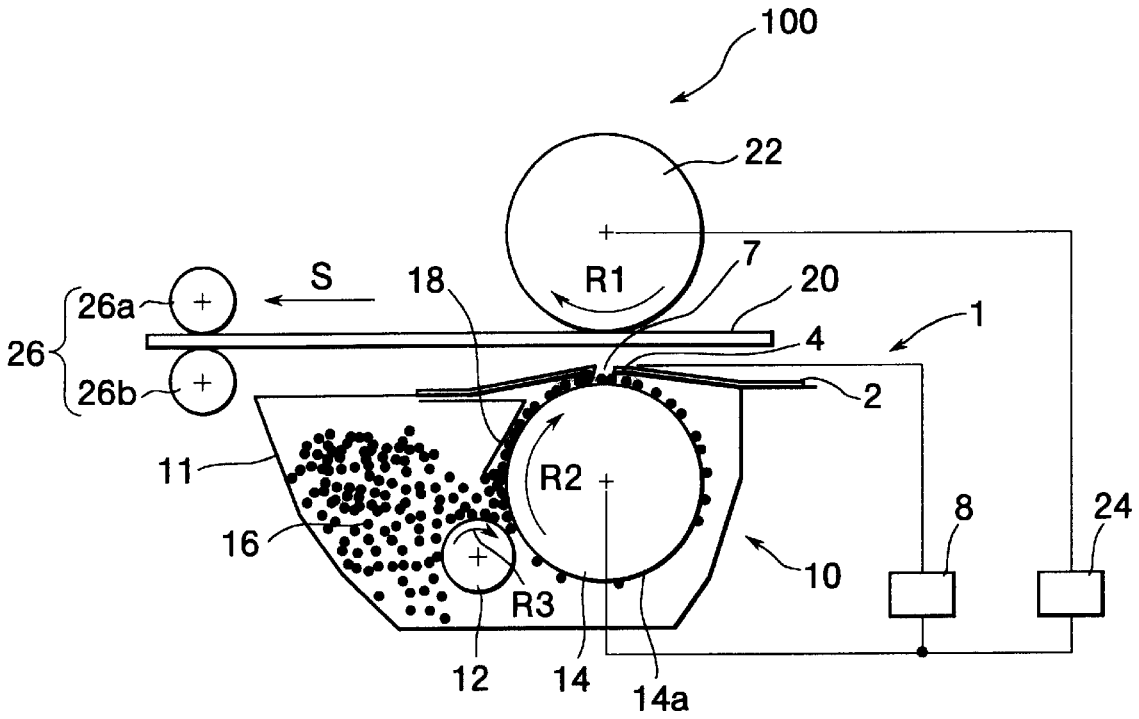
FIG. 1 is a schematic view showing an image forming device according to an embodiment of the present invention.

As shown in FIG. 1, an image forming device 100 includes an aperture electrode member 1, a back electrode roller 22, a toner supply unit 10, a fixing unit 26, a control circuit 8, a direct current power source 24, and a recording medium supply unit (not shown). The back electrode roller 22 has a cylindrical shape and is disposed above the aperture electrode member 1 and separated from the aperture electrode member 1 by a distance of 1 mm. The back electrode roller 22 is supported by a chassis (not shown) so as to be rotatable in a direction indicated by an arrow R1. The recording medium supply unit supplies a recording medium, such as a paper sheet, between the aperture electrode member 1 and the back electrode roller 22. Rotation of the back electrode roller 22 transports the recording medium 40 in a sheet feed direction indication by an arrow S. The fixing unit 26 includes a pair of rollers 26*a*, 26*b* rotatably disposed downstream from the back electrode roller 22 in the sheet feed direction S.

The toner supply unit 10 is disposed beneath the aperture electrode member 1, and includes a toner case 11, a supply roller 12, a toner bearing roller 14, and a blade 18. The toner case 11 stores toner particles 16 and serves as a housing of the image forming device 100. The supply roller 12 and the toner bearing roller 14 are rotatably disposed within the toner case 11 in contact with each other. The supply roller 12 and the toner bearing roller 14 are rotatable in directions indicated by arrows R2, R3, respectively. The toner bearing roller 14 has a peripheral surface 14*a*. Rotation of the supply roller 12 supplies the toner particles 16 onto the peripheral surface 14*a* of the toner bearing roller 14. The supplied toner particles 16 are transported toward the aperture electrode member 1 as the toner bearing roller 14 rotates.

The blade 18 is provided for pressing against the toner bearing roller 14 to regulate the amount of toner particles 16 borne on the toner bearing roller 14. As a result, the toner particles 16 is formed to a uniform thickness on the peripheral surface 14*a* of the toner bearing roller 14. Contact with the blade 18 also adds a uniform negative charge in the toner particles 16.

The toner bearing roller 14 and conductors 6 (described later) are electrically connected via the control circuit 8. The control circuit 8 selectively applies a voltage of 0V and +50V to the control electrodes 4 based on an image signal.

Also, the back electrode roller 22 and the toner bearing roller 14 are electrically connected via the direct current power source 24. The direct current power source 24 applies a voltage of 1 kV to the back electrode roller 22.

Figure 2:
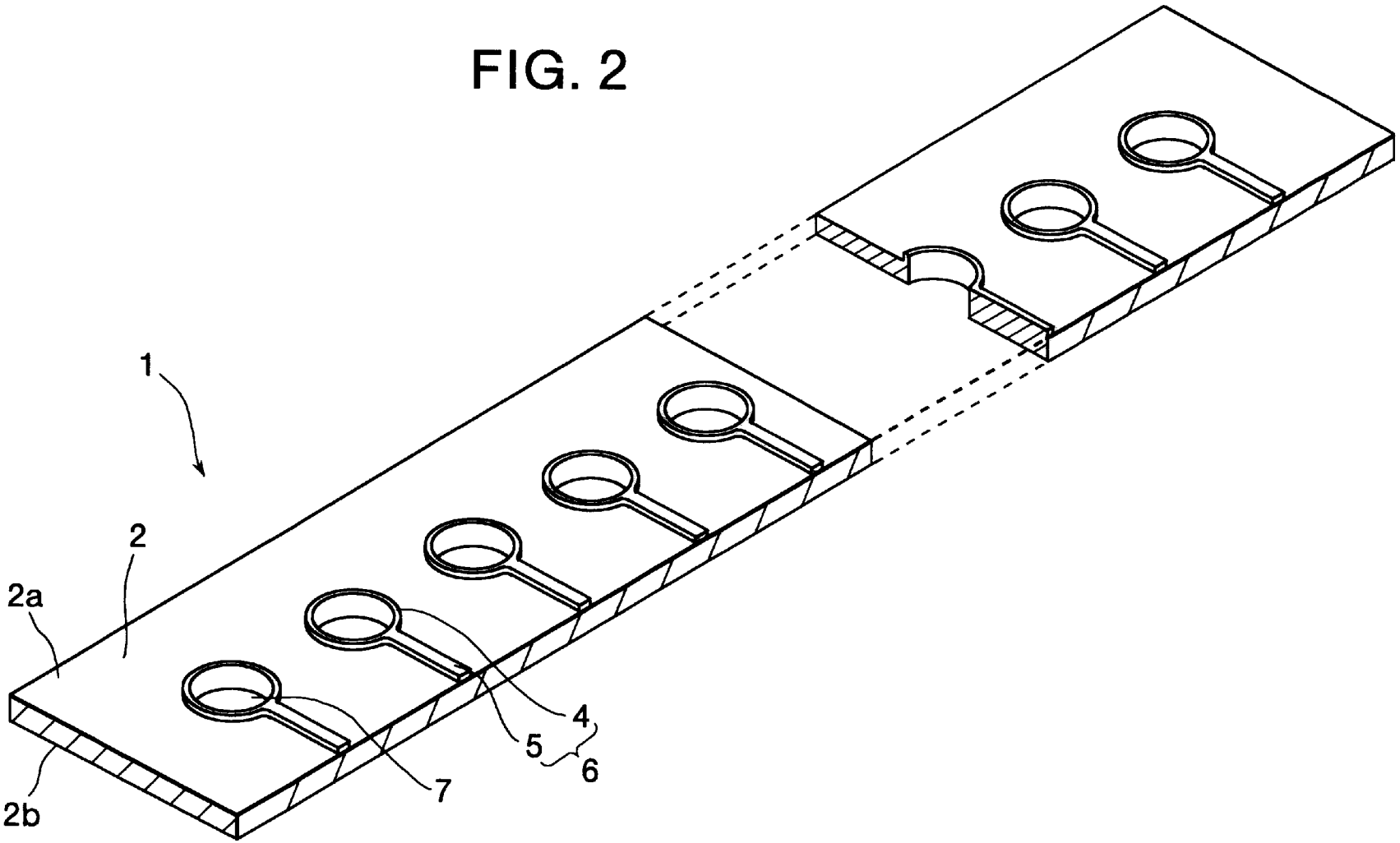
FIG. 2 is a perspective view showing an aperture electrode member of the image forming device of the FIG. 1.
Figure 3:
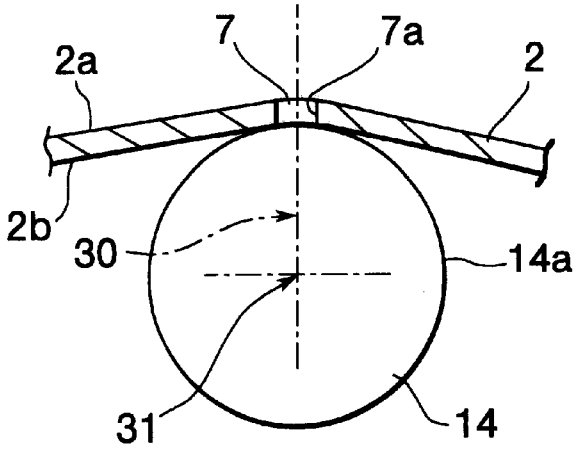
FIG. 3 is a cross-sectional view showing the aperture electrode member and a toner bearing roller of the image forming device of FIG. 1.

As shown in FIGS. 2 and 3, the aperture electrode member 1 includes an insulation sheet 2 and a plurality of conductors 6. The insulation sheet 2 is formed from polyimide to a thickness of 25 μm. The insulation sheet 2 has an upper surface 2*a* and a lower surface 2*b* and is formed with a plurality of apertures 7 arranged in a row. Each aperture 7 has a diameter of 100 μm. The conductors 6 are formed to a thickness of 8 μm on the upper surface 2*a* of the insulation sheet 2 in a one-to-one correspondence with the apertures 7. Each conductor 6 includes a control electrode 4 surrounding around the aperture 7 and a conductor portion 5 extending from the control electrode 4.

Next, a detailed description of the positional relationship between the aperture electrode member 1 and the toner bearing roller 14 will be provided while referring to FIG. 3. As shown in FIG. 3, the toner bearing roller 14 has a center axis 31. The aperture electrode member 1 is positioned above the toner bearing roller 14 with the center of the apertures 7 and the center axis 31 of the toner bearing roller 14 in vertical alignment as shown by a dotted line 30. With this configuration, the apertures 7 are positioned uniformly to the left and right on the upper most position of the toner bearing roller 14. Also, an aperture wall 7*a* defining the aperture 7 extends in the vertical direction In which the toner particles 16 flow through the aperture 7. Therefore, the toner particles 16 can pass through the aperture 7 with a uniform distribution across the entire region of the aperture 7. Also, the toner particles 16 can stably flow through the aperture 7.

Further, the aperture electrode member 1 is flexible and presses against the toner supply roller 14 so as to resiliently bend along the peripheral surf ace 14*a* at the same angle to both the left and right with respect to the line 30. For this reason, the aperture electrode member 1 can contact the toner bearing roller 14 with a large contact area. Also, because the aperture electrode member 1 at portions around the apertures 7 press uniformly against the toner bearing roller 14, a toner image can be formed without a variation in toner density.

Figure 4A:
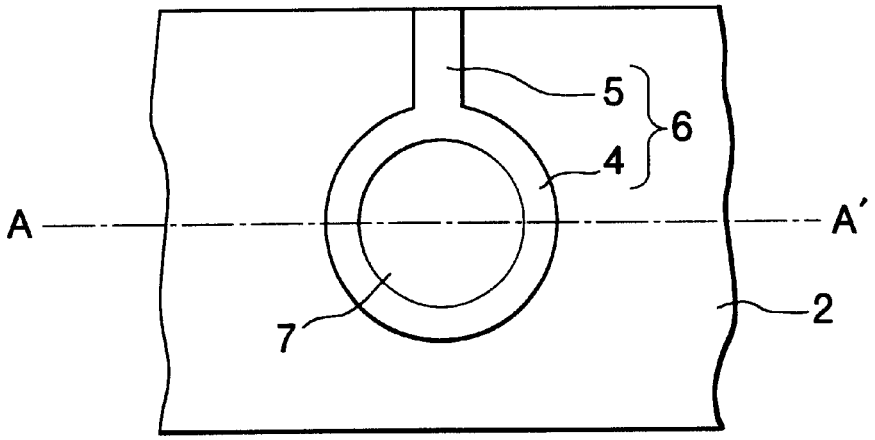
FIG. 4(*a*) is a partial plan view showing a first process in production of the aperture electrode member.
Figure 4B:
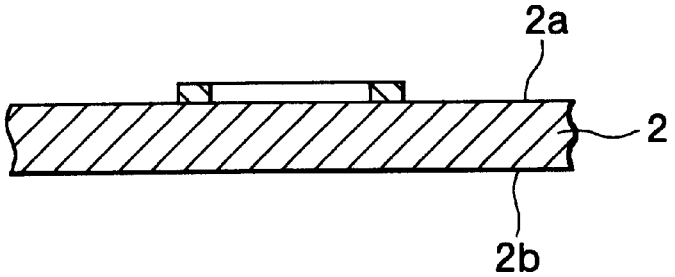

Next, a method for producing the aperture electrode member 1 will be described while referring to FIGS. 4(*a*) through 9(*b*). First, the insulation sheet 2 is formed from a resin film, such as polyimide or polyester, to the thickness of 25 μm. In this embodiment the insulation sheet 2 is formed of polyimide.

Then, the upper surface 2*a* of the insulation sheet 2 is plated with an electrically conductive film to a thickness of 8 μm. The electrically conductive film can be any conductive film, for example, metal materials, such as chrome, tungsten, steel, aluminum, and copper. In this embodiment, copper film called a material film produced by Toyo Metallizing Co., Ltd is used as the conductive film.

Next, using a spin coating method or dipping method, a photosensitive resist is formed over the conductive film plated on the resisting sheet 2. Then, an ultraviolet light is irradiated onto the resultant material through an exposure mask having patterns corresponding to the conductors 6. Next, separation liquid is applied to the resultant product to remove unneeded photosensitive resist. As a result, photosensitive resist patterns corresponding to the conductors 6 are formed on the conductive film.

Next, unnecessary portions of the conductive film are removed by an etching process. More specifically, etching liquid, such as ferric chloride, is applied onto the upper surface 2*a* of the insulation sheet 2. When the conductive film is exposed to the etching liquid, the conductive film is oxidized and removed from the upper surface 2*a* of the insulation sheet 2. However, because the portion of the conductive film coated with the photosensitive resist will not be exposed to the etching liquid, the coated portion of the conductive film remains on the upper surface 2*a* without being removed. As a result, only a conductive film pattern corresponding to the conductors 6 remains on the insulation sheet 2. In this way, as shown in FIGS. 4(*a*) and 4(*b*), the conductors 6 are formed on the upper surface 2*a* of the insulation sheet 2.

Figure 5A:
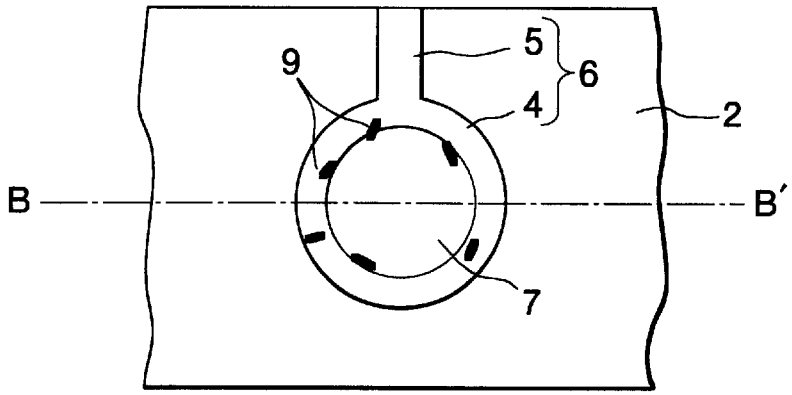
FIG. 5(*a*) is a partial plan view showing a second process in the production of the aperture electrode member.
Figure 5B:
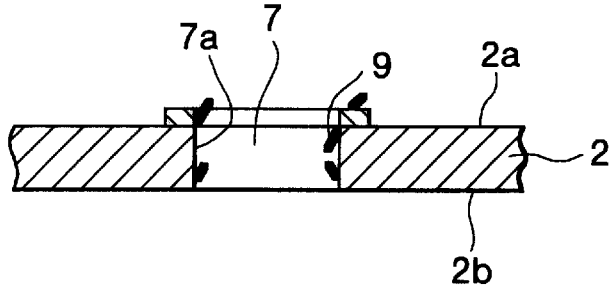

Next, the insulation sheet 2 is formed with the apertures 7. Specifically, an excimer laser is irradiated onto desired spots on the insulation sheet 2 from the above. The exciser laser is an ultraviolet light laser that induces a photochemical reaction called ablation to macromolecular compound materials. Usually, a macromolecular compound is mainly formed from carbon atoms and oxygen atoms connected to one another by bond chains. Theoretically, the ablation brakes down the bond chains and scatters oxygen and carbon particles. Therefore, when exposed to the excimer laser, the insulation sheet 2 is formed with holes, that is, the apertures 7. At this time as shown in FIGS. 5(*a*) and 5(*b*), scattered carbon particles 9 cling onto the aperture side walls 7*a* and the upper surface 2*a* around the apertures 7.

Next, these carbon particles 9 are removed using a wet blast techniques. It should be noted that if the carbon particles 9 were not removed, the carbon particles 9 could cause shorts between adjacent control electrodes 4 and disturb electronic fields (described later) generated in the interior of the apertures 7.

In the wet blast process, grinding powder solution is sprayed onto the entire insulation sheet 2 from either side of the insulation sheet 2, so that the carbon particles 9 are blasted away. The grinding powder solution is, for example pure water with 20% in volume aluminum grinding powder No. 800 dispersed therein. In this embodiment the grinding powder solution is sprayed at the insulation sheet 2 with a blasting pressure of 1.8 kg/m.

Figure 6A:
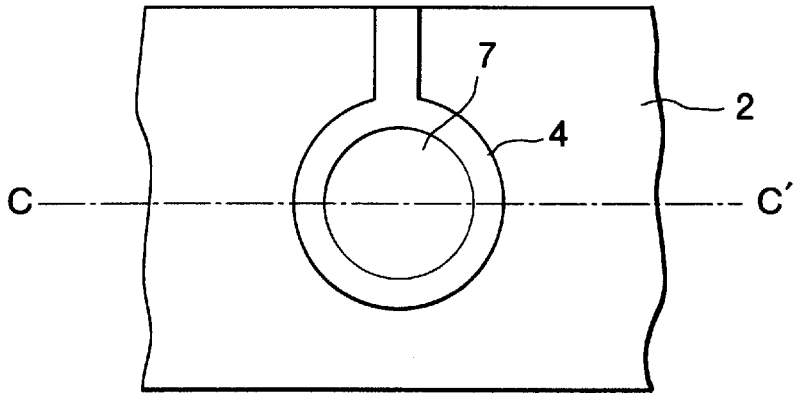
FIG. 6(*a*) is a partial plan view showing a third process of the production of aperture electrode member.
Figure 6B:
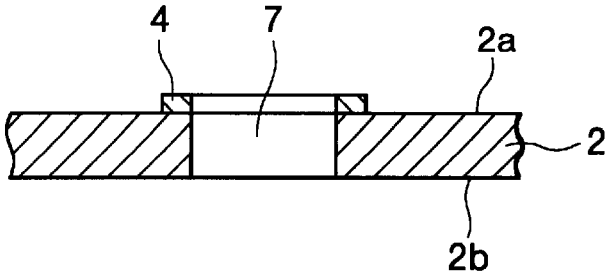

It should be noted that although grinding powder is directly sprayed onto a subject material during sand blasting processes, during wet blasting the grinding powder is dispersed in water and so can be gently sprayed onto the subject material. Therefore, the aperture electrode member 1 will not be damaged using wet blasting. Also, because the water constantly cools down the subject material, the insulation sheet 2 can be prevented from deforming due to heat generated during the wet blasting, and the insulation sheet 2 can be maintained, as shown in FIGS. 6(*a*) and 6(*b*), without undesirable distortion. Therefore, a toner image can be formed without a variation in toner density.

Next, processes for forming a slide facilitating layer 20 and a charge prevention layer 70 at the same time on the insulation sheet 2 will be described while referring to FIGS. 7(*a*) to 9(*b*). The slide facilitating layer 20 and the charge prevention layer 70 are formed on the lower surface 2*b* of the insulation sheet 2 and on the aperture side walls 7*b*, respectively.

Figure 7A:
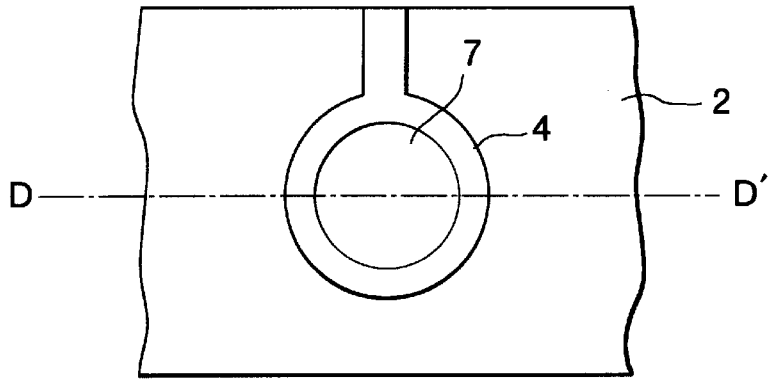
FIG. 7(*a*) is an explanative view showing a fourth process of the production of the aperture electrode member.
Figure 7B:
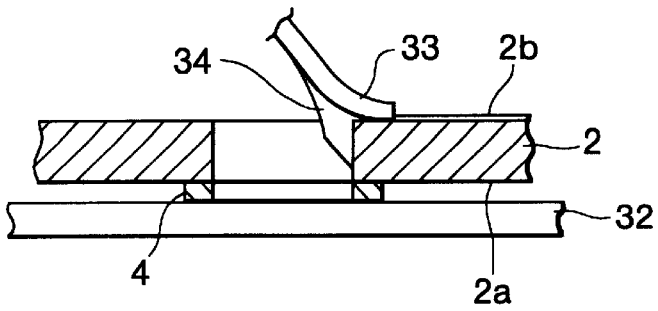
Figure 8A:
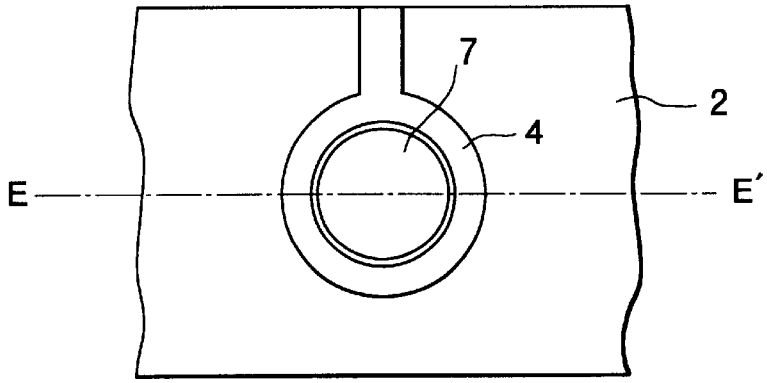
FIG. 8(*a*) is a cross-sectional view showing a fifth process of the production of the aperture electrode member.
Figure 8B:
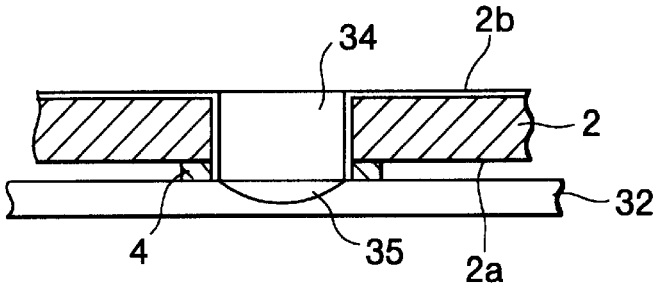

First, as shown in FIG. 7(*b*), an absorption sheet 32 is disposed in intimate contact with the upper surface 2*a* of the insulation sheet 2. Then, coat liquid 34 is applied onto the lower surface 2*b* of the insulation sheet 2 using a squeegee 33 formed from a silicon member.

The coat liquid 34 is polyimide ink with electrically conductive particles dispersed therein. When the coat liquid 34 is dried and hardened, the coat liquid 34 loses its high conductivity. In the present embodiment, about 15% polyimide ink by weight with carbon particles dispersed therein is used as the coat liquid. The carbon particles comprise 7% of the solids contents by weight, that is, 7% of the total of the polyimide and carbon contents.

The squeegee 33 is moved across the entire lower surface 2*b* of the insulation sheet 2 while applying the coat liquid 34. As a result, the lower surf ace 2*b* is covered with a suitable amount of the coat liquid 34. Also, as shown in FIG. 6(*b*), the apertures 7 are filled up with excessive coat liquid 35 at this time. However, the excessive coat liquid 35 is absorbed into the absorption sheet 32 and removed by pulling the absorption sheet 32 away from the insulation sheet 2. As a result, a desirable amount of the coat liquid 34 will remain over the aperture side walls 7. In this way, the coat liquid 30 can be coated only an desired portions of the insulation sheet 2.

Figure 9A:
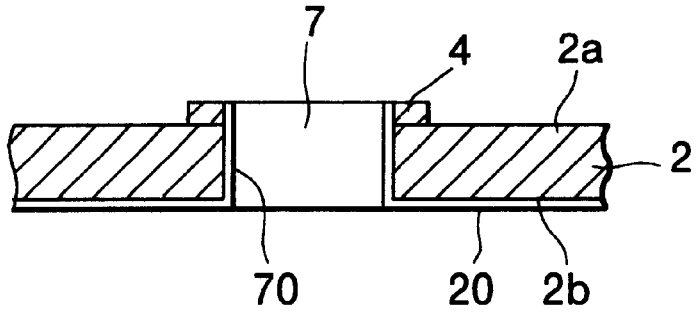
FIG. 9(*a*) is a cross-sectional view showing a sixth process of production of the aperture electrode member.
Figure 9B:
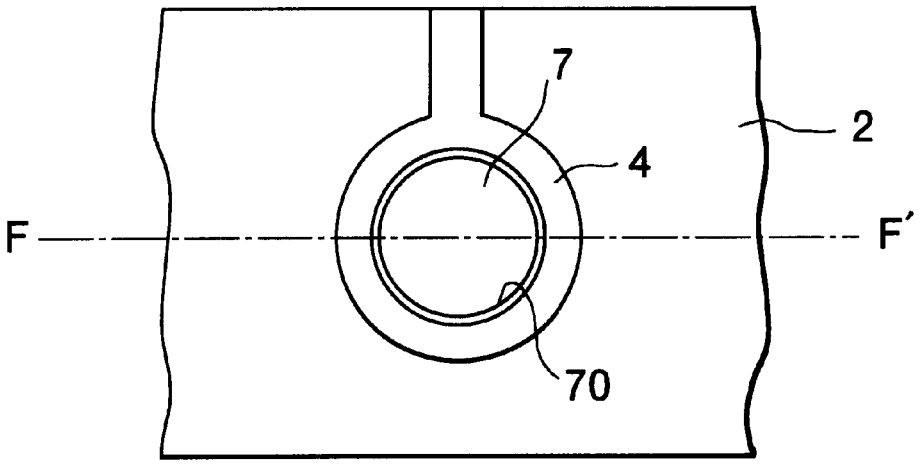

Then, as shown in FIGS. 9(*a*) and 9(*b*), the coat liquid 34 is dried and hardened, thereby forming a charge prevention layer 70 on the aperture side wall 7*a* and the slide facilitating layer 20 on the lower surface 2*b* of the insulation sheet 2. The slide facilitating layer 20 on the insulation sheet 2 facilitates smooth sliding of the toner bearing roller 14 over the insulation sheet 2.

According to tests performed, a porous sheet with great water-absorbing properties can quickly absorb the coat liquid 34. Therefore, it is desirable to form the absorption sheet 32 from a material having such properties. Also, the absorption sheet 32 should be made of material including no fibers. For example, a filter paper is not an appropriate material. When the absorption sheet 32 includes no fibers, it will not snag on the lower surface 2*b* of the insulation sheet 2 when removed therefrom. Therefore, fibers or any other undesired foreign matter will not cling to the insulation sheet 2 or the aperture side walls 7*a*.

As described above, the slide facilitating layer 20 and the charge prevention layer 70 can be formed in a simple manner without retaining excessive coat liquid 35.

Next, a brief explanation of operations performed by the above-described image forming device 100 will be provided while referring to FIG. 1.

Rotation of the supply roller 12 in the direction R3 supplies toner particles 16 onto the peripheral surface 14*a* of the toner bearing roller 14. Because the toner bearing roller 14 is also rotating in the direction R2 while contacting the supply roller 12, the toner particles 16 are scraped between the supply roller 12 and the toner bearing roller 14, and are given a negative charge as a result. The charged toner particles 16 are transported on the toner bearing roller 14 in the direction R2. Then, the amount of the toner particles 16 is regulated by the blade 18 so as to form a uniform-thick layer of toner particles 16. At this time, the toner particles 16 are further negatively charged by friction with the blade 18. Then, the toner particles 16 on the toner bearing roller 14 are supplied beneath the apertures 7 while scraping against the insulation sheet 2 of the aperture electrode member 1.

Based on an image signal, the control circuit 8 selectively applies either a voltage of 50 volts of a voltage of 0 volt to the control electrodes 4. That is, the control circuit 8 applies a voltage of 50 volts to produce a toner dot and a voltage of 0 volt for when no dot is to be formed. When the control electrode 4 is supplied with a voltage of 50 volts, an electric field is generated between the control electrode 4 and the toner bearing roller 14. As a result, the negatively charged toner particles 16 are pulled toward the control electrode 4 due to electrostatic attraction. Because a stronger electric field is generated between the back electrode roller 22 and the control electrode 4, the toner particles 16 are further drawn through the aperture 7 toward the back electrode roller 22 and, then, impinge onto the recording medium 40 being transported between the control electrode 4 and the back electrode roller 22. In this way, one image dot is formed.

On the other hand, when a voltage of 0V is applied to the control electrode 4, no electric field will be generated so that the toner particles 16 will remain on the peripheral surface 14*a* of the toner bearing roller 14. Therefore, no dot image is formed.

Then, the recording medium 40 is transported one dot's worth distance in the sheet feed direction S, and the above-described process is repeated for forming images. By repeating these processes, a page's worth of toner image can be formed on the recording medium 40. Afterwards, the toner image formed on the recording medium 40 is fixed on the recording medium 40 by the fixing unit 26. In this way, a desired image is formed on the recording medium 40.

As described above, no carbon particles generated during the manufacturing process of the aperture electrode member 1 cling to the aperture electrode member 1 at areas around the apertures 7. Therefore, shorts will not occur between adjacent control electrodes, and printing can be stably performed. Further, the charge prevention layer 70 formed on the aperture side wall 7*a* prevents a charge from being developed on the aperture side wall 7*a* when the toner particles 16 pass through the aperture 7. This prevents the toner particles 16 from accumulating on the aperture side wall 7*a* due to static electricity. Therefore, the aperture 7 will not be clogged up with toner particles 16.

Further, because the charge prevention layer 70 on the aperture side wall 7 and the slide facilitating layer 20 on the lower surface 2*b* of the insulation sheet 2 are formed from the same material, that is, from the coat liquid 34. The toner particles 16 contact only one kind of material after being supplied to the aperture electrode member 1 until impinging on the recording medium 40. This enables precise control of flow of toner particles 16 through the apertures 7.

According to the above-described method for producing the aperture electrode member 1, the coat liquid 34 is applied from the lower surface side onto the lower surface 2*b* of the insulation sheet 2 so as to be uniformly coated over the lower surface 2*b* without unevenness. Therefore, the toner particles 16 can be evenly rubbed between the toner bearing roller 14 and the aperture electrode member 1. As a result, a toner image with a uniform toner density can be obtained.

Further, for example, if the charge prevention layer 70 is formed after the slide facilitating layer 20 is formed, the slide facilitating layer 20 may be damaged during the process for forming the charge prevention layer 70. However, according to the present invention, the charge prevention layer 70 and the slide facilitating layer 20 are formed simultaneously, so that the slide facilitating layer 20 and the charge prevention layer 70 can be formed without being damaged. Also, this simplifies the process for forming the slide facilitating layer 20 and the charge prevention layer 70, so the production yields are improved and manufacturing costs are reduced.

Because the slide facilitating layer 20 also function as charge prevention layer, the toner particles 16 can be prevented from accumulating onto the lower surface 2*b* of the insulation sheet 2. Therefore, supply of the toner particles 16 will not be obstructed and high printing quality can be maintained.

While the invention has been described in detail with reference to specific embodiments thereof, it would be apparent to those skilled in the art that various changes and modifications may be made therein without departing from the spirit of the invention, the scope of which is defined by the attached claims.

The absorption sheet 32 can be formed from a high macromolecular absorption polymer which is used in, for example, paper diapers. Alternatively, the excessive coat liquid 35 can be removed by generating a negative pressure atmosphere on the upper surface 2*a* of the insulation sheet 2.

Also, the coat liquid 34 can be applied on the insulation sheet 2 using screen printing processes. According to this method, the amount of coat liquid to be applied onto the insulation sheet 2 can be controlled by selecting the size of the screen mesh. Therefore, it is desirable to use this method during production.

Further, the apertures 7 can be rectangular rather than circular. Also, the control electrodes 4 need not surround the corresponding apertures 7 as long as the control electrodes 4 can control flow of the toner particles 16 through the apertures 7.

What is claimed is:

1. An aperture electrode assembly for an image forming device including a recording particle supply unit for supplying electrically charged recording particles for the aperture electrode assembly, the aperture electrode assembly comprising:

a substrate formed with a plurality of apertures through which electrically charged recording particles pass through, each of the plurality of apertures being defined by an aperture side wall, the substrate having a first surface and a second surface opposite from the first surface, the first surface of the substrate being covered with a first layer, the aperture side walls being covered with a second layer, the substrate being designed to be positioned so that at least a portion of the first layer is in intimate contact with the recording particle supplying member, wherein the first layer and the second layer are formed from a same material and are electrical charge preventing layers; and a plurality of electrodes provided on the second surface of the substrate for respective ones of the plurality of apertures.

2. The image forming device according to claim 1, wherein the electrical charge preventing layers include electrically conductive particles.

3. The image forming device according to claim 2, wherein the electrical charge preventing layers are formed through a process of drying and hardening.

4. An image forming device comprising:

a recording particle supply unit that supplies electrically charged recording particles:

an aperture electrode assembly including a substrate and a plurality of control electrodes, the substrate having a first surface coated with a first layer and a second surface opposite from the first surface, the substrate being formed with a plurality of apertures each defined by an aperture side wall coated with a second layer, the plurality of control electrodes being provided on the second surface of the substrate for respective ones of the plurality of apertures, wherein the first layer and the second layer are formed from a same material and form an electrical charge preventing coat layer;

a frame that supports the aperture electrode assembly such that at least a portion of the first layer is in intimate contact with the recording particle supply unit; and a control unit that generates an electric field between the recording particle supply unit and selective control electrodes so that the electrically charged recording particles are selectively pulled through respective apertures toward the selective control electrodes due to an electrostatic attraction of the electric field.

5. The image forming device according to claim 4, wherein the electrical charge preventing coat layer includes electrically conductive particles.

6. The image forming device according to claim 5, wherein the first layer facilitates smooth slide of the recording member supply unit over the substrate.

7. The image forming device according to claim 6, wherein the electrical charge preventing layers are formed through a process of drying and hardening.

8. The image forming device according to claim 5, wherein the second layer prevents static electricity from being generated inside of the plurality of apertures.

9. The image forming device according to claim 8, wherein the electrical charge preventing layers are formed through a process of drying and hardening.

10. A method for producing an aperture electrode assembly comprising the steps of:

a) forming a plurality of electrode members on a first surface of a substrate;

b) forming a plurality of apertures penetrating the substrate and respective ones of the plurality of electrode members, the plurality of electrode members formed with corresponding ones of the plurality of apertures defining a plurality of electrodes, the plurality of apertures being defined by aperture side walls;

c) applying coat liquid onto a second surface of the substrate and into the plurality of apertures from a second surface side of the substrate; and d) drying the coat liquid so as to form a coat layer over the second surface and the aperture side walls.

11. The method according to claim 10, wherein the coat liquid is an electrical charge preventing liquid.

12. The method according to claim 11, wherein the electrical charge preventing liquid includes electrically conductive particles.

13. The method according to claim 10, further comprising the step of e) placing an absorption sheet over the first surface of the substrate before the step c).

14. The method according to claim 13, further comprising the steps of f) absorbing excessive coat liquid into the absorption sheet before the step d), and g) removing the absorption sheet away from the first surface of the substrate after the step d), wherein the absorption sheet is a porous member in a sheet configuration without having a fiber.

15. The method according to claim 10, wherein the substrate is formed from a macromolecular compound material, and the plurality of apertures are formed in the step b) by using an excimer laser.

16. The method according to claim 15, further comprising the step of h) removing carbon particles after the step b) from the substrate by spraying powder solution to the substrate.

17. The method according to claim 10, wherein the coat layer formed on the second surface of the substrate is a slide facilitating layer, and the coat layer formed on the aperture aide walls are charge prevention coat layer.

18. The method according to claim 10, wherein the coat liquid is polyimide ink with electrically conductive particles dispersed therein.

19. The method according to claim 10, wherein the coat layers are formed over the second surface of the substrate and the aperture side walls simultaneously.

* * * * *